United States Patent [19]

Kolobow et al.

[11] 4,356,958

[45] Nov. 2, 1982

[54] BLOOD CELL SEPARATOR

[75] Inventors: Theodor Kolobow, Rockville; Yoichiro Ito, Bethesda, both of Md.

[73] Assignee: The United States of America as represented by the Secretary of Health and Human Services, Washington, D.C.

[21] Appl. No.: 90,390

[22] Filed: Nov. 1, 1979

Related U.S. Application Data

[62] Division of Ser. No. 817,016, Jul. 19, 1977.

[51] Int. Cl.[3] ..... B04B 1/00

[52] U.S. Cl. ..... 233/27; 233/1 R

[58] Field of Search ..... 233/1 R, 1 E, 14 R, 233/15, 27, 28, 29, 34, 35, 38, 39, 40, 41, 46, 47

[56] References Cited

U.S. PATENT DOCUMENTS

| | | | |
|---|---|---|---|
| 2,730,299 | 1/1956 | Kelsey | 233/27 |
| 3,703,984 | 11/1972 | Pruessner | 233/28 |
| 3,987,961 | 10/1976 | Sinn | 233/27 |
| 4,007,871 | 2/1977 | Jones | 233/27 |
| 4,010,894 | 3/1977 | Kellogg et al. | 233/27 |

FOREIGN PATENT DOCUMENTS

| | | | |
|---|---|---|---|
| 873494 | 7/1961 | United Kingdom | 233/28 |

*Primary Examiner*—Robert W. Jenkins

*Attorney, Agent, or Firm*—Vito J. DiPietro; Thomas J. Byrnes; Herbert Berl

[57] ABSTRACT

A centrifugal blood component separator with a spiral helically inclined rotor chamber. The apparatus uses continuous blood flow-through without rotating seals. At the lower end of the helical rotor chamber there are terminals for blood input and packed red blood cell output, whereas at the higher end there is a terminal for plasma. Intermediate outlet terminals may be provided for white blood cells and platelets.

28 Claims, 14 Drawing Figures

BLOOD CELL SEPARATOR

This is a division, of application Ser. No. 817,016 filed July 19, 1977.

FIELD OF THE INVENTION

This invention relates to centrifuge devices, and more particularly to a centrifuge apparatus for separating the components of blood.

BACKGROUND OF THE INVENTION

In the prior art many centrifuge devices have been proposed for the separation of the various fractional components of blood. Usually these devices involve the utilization purely of centrifugal force acting on the different-mass components of blood samples. In some cases there is flow-through, employing rotating seals. However, there have been flow-through centrifuge devices without rotating seals. Such a device has been recently described for on-line plasmapheresis of whole blood, in Y. Ito, J. Suaudeau, and R. L. Bowman, Science, 189, 999, 1975.

The prior art devices are either relatively slow-acting, cause some damage to the harvested blood components, have limited capacity, or require the use of anticoagulants.

The following is a list of prior art U.S. Pat. Nos. pertinent to the present invention, found in a preliminary search:

Williams, 3,908,893;
Westberg, 3,817,449;
Unger, et al 3,858,796;
Sartory, et al, 3,957,197;
Schlutz, 3,982,691;
Jones, et al 4,007,871;
Kellogg, 4,010,894;
Judson, et al 3,655,123;
Adams, 3,586,413;
Ito, et al 3,775,309.

SUMMARY OF THE INVENTION

The general aim of the present invention is to provide for the simple and very rapid collection of red blood cells, white blood cells or platelets, or plasma, wherein this collection can be made independently of the other blood components, for example, wherein only platelets can be harvested, or only plasma can be harvested, or, if so desired, all blood components can be harvested at the same time in separate containers.

Accordingly, a main object of the present invention is to provide a blood components separator which is free of the deficiencies of the prior art devices heretofore proposed or employed.

A further object of the invention is to provide an improved simple and rapid means for the collection of the components of blood.

A still further object of the invention is to provide an improved flow-through blood centrifuge device which does not employ rotating seals.

A still further object of the invention is to provide an improved centrifuge apparatus for individually harvesting blood components, wherein the components are handled gently without damage, and wherein the apparatus has a relatively large capacity.

A still further object of the invention is to provide an improved flow-through device for the selective collection of red blood cells, white blood cells or platelets, or plasma, wherein the collection of the individual components may be independently made, and wherein, if desired, all the blood components can be harvested at the same time in separate containers.

Another object is to broadly provide for the improved separation of fragile multi-phase systems, such as blood, into separate components.

A still further object of the invention is to provide an improved device for the separation and collection of blood components, said device employing the combination of centrifugal force and gravity to separate out the various components with a high degree of resolution.

A still further object of the invention is to provide an improved centrifugal blood component separator with a spiral helically inclined rotor chamber, using continuous blood flow-through without rotating seals, wherein terminals are provided for blood input, red blood cell output, and output of other blood components, and wherein selective collection of the blood components may be accomplished, the separator causing minimum damage to the blood components and having a high capacity.

The foregoing objects, as well as others, are achieved in accordance with the present invention by providing a separation chamber in the form of a helical spiral channel, with terminals for the blood inlet and packed red blood corpuscle outlet, and for plasma, white blood corpuscles and/or platelet outlets. Blood cells sediment in a radially acting centrifugal field. In this spiral configuration, blood flows "uphill" against a "g" force gradient which forces heavier cells to travel in opposite direction to plasma and lighter cells (countercurrent flow), each fraction being continuously harvested through its respective terminal.

BRIEF DESCRIPTION OF THE DRAWINGS

The objects and advantages of the invention will become further apparent from the following description and claims, and from the accompanying drawings, wherein:

DESCRIPTION OF PREFERRED EMBODIMENTS

Figure 1:
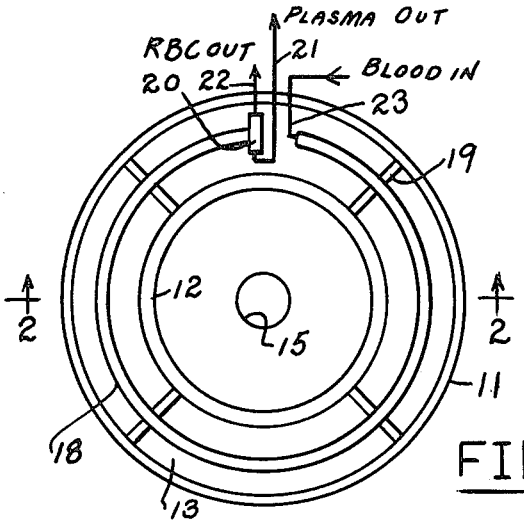
FIG. 1 is a diagrammatic top plan view of a blood centrifuge bowl assembly employing a generally circular separation chamber located substantially in a horizontal plane.
Figure 2:
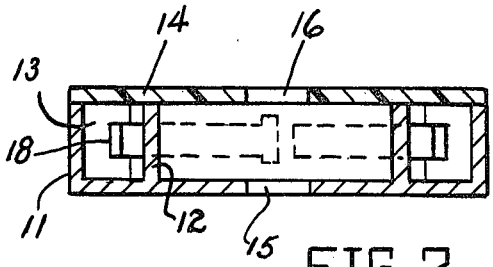
FIG. 2 is a transverse vertical cross-sectional view taken substantially on line 2—2 of FIG. 1.
Figure 3:
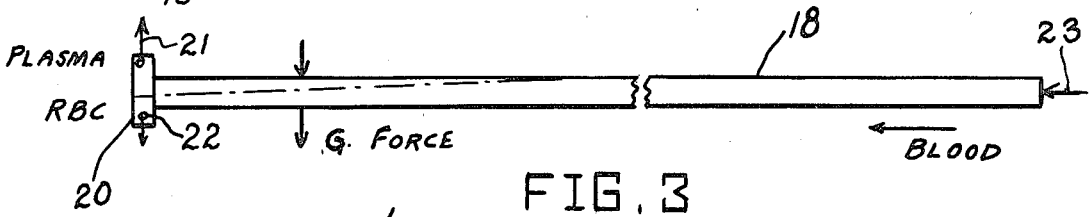
FIG. 3 is an elevational view of the separation chamber of FIGS. 1 and 2 in developed form.
Figure 8:
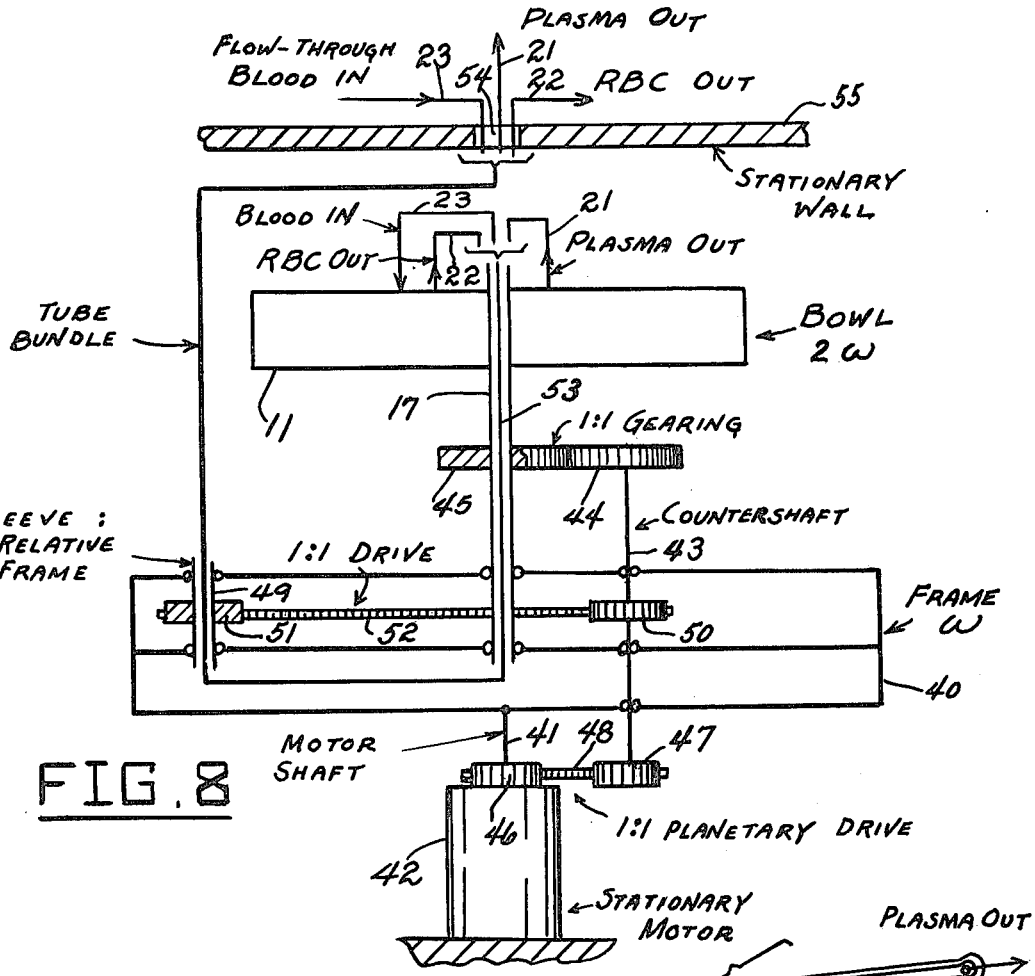
FIG. 8 is a schematic diagram of a flow-through blood centrifuge system which may employ a bowl assembly according to the present invention without requiring the use of rotating seals.

Referring to the drawings, FIGS. 1, 2 and 3 show a typical horizontal rotor assembly for the centrifugal separation of blood components. Said assembly comprises a horizontal centrifuge bowl 11 of circular shape having an annular concentric inner wall 12 spaced from the outer wall of the bowl and defining therewith an annular compartment 13. The bowl is provided with a generally circular top cover 14. The bowl 11 may be made of aluminum and the top cover 14 may be made of acrylic plastic material. The bottom wall of the bowl is provided with a central aperture 15 and the top cover is provided with a similar central aperture 16. The apertures 15 and 16 enable the bowl assembly to be secured on a vertical driving sleeve 17 forming part of a driving system without rotating seals, as shown diagrammatically in FIG. 8, presently to be described.

Concentrically mounted horizontally in the compartment 13 is a generally circular separation chamber 18 which may comprise a hollow ring-like memnber of rectangular cross-section suitably supported concentrically in compartment 13, for example, by a plurality of spaced radial brackets 19. A typical chamber 18 has a cross-section 3.5 cm high and 0.45 cm wide, has a length of 100 cm and a total prime volume of 180 ml.

At one end the chamber 18 is provided with a generally rectangular, radially extending, terminal enlargement 20 which is used as a component outlet collection enclosure. Thus, the inner end of the outlet terminal enclosure 20 is connected to a flexible plasma collection line 21 and the outer end of the enclosure 20 is connected to a red blood cell flexible collection line 22. A blood inlet connection is made to the opposite end of chamber 18 by a flexible tube, shown at 23.

As shown in FIG. 3, the red blood cell connection to line 22 is made at the bottom of terminal enclosure 20, whereas the plasma connection to line 21 is made at the top portion of enclosure 20.

In operation, when bowl 11 rotates at operating speed, with blood flowing into the chamber 18 through the inlet 23, centrifugal force tends to separate the red blood cells from the plasma and the gravitational field acts on the red blood cells, tending to cause them to descend to the bottom portion of the chamber 18, whereas the plasma collects in the upper portion thereof. The red blood cells are drawn off through the collection line 22 and are delivered to their intended destination, whereas the plasma is drawn off and delivered via the collection line 21.

Figure 4:
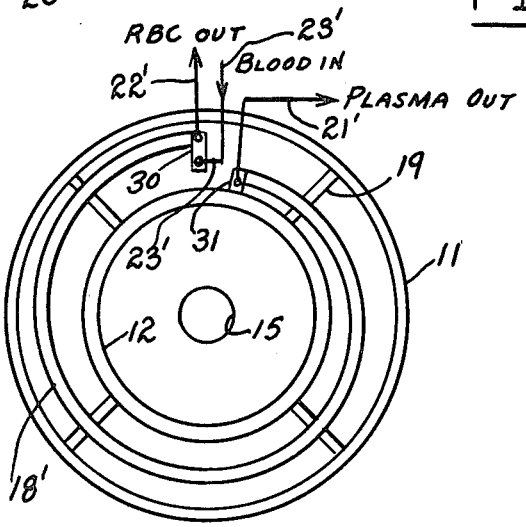
FIG. 4 is a diagrammatic top plan view of a blood centrifuge bowl assembly employing a helical spiral separation chamber in accordance with the present invention.
Figure 5:
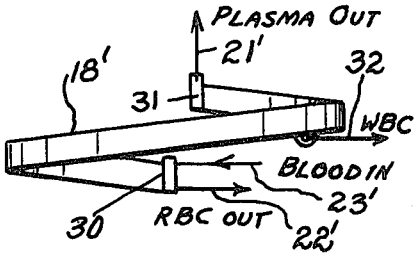
FIG. 5 is an elevational view of the helical blood separation chamber employed in the assembly of FIG. 4.
Figure 6:
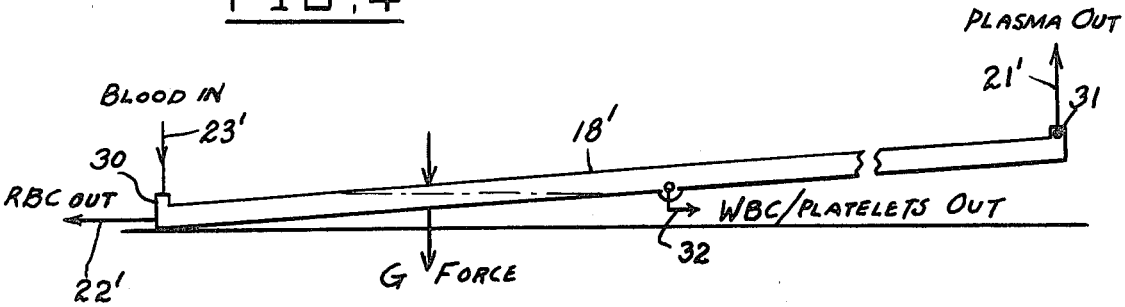
FIG. 6 is an elevational view of the separation chamber of FIGS. 4 and 5 in developed form.

Significantly improved operation is obtained by arranging the separation chamber in a spiral helical configuration, as shown in FIGS. 4, 5 and 6. In this arrangement, the separation chamber, shown at 18', is in spiral helical form and has an enlarged generally rectangular, inwardly radially extending terminal enclosure 30 at its lower end and a generally rectangular, inwardly extending terminal enclosure 31 at its higher end. In the spiral configuration shown in FIG. 4, the higher end terminal enclosure 31 is located inwardly relative to the lower end terminal enclosure 30, with respect to the vertical central axis of the chamber 18'.

The blood inlet line, shown at 23', is connected to the upper end of terminal enclosure 30. The red blood cell outlet line, shown at 22', is connected to the lower end of terminal enclosure 30. The plasma outlet line, shown at 21', is connected to the higher end terminal enclosure 31. A white blood cell/platelet collection line 32 may be connected to a suitable intermediate portion of the collection chamber 18'.

This provides terminals for the blood inlet flow and for the packed red blood cells, plasma and white blood cell/platelet flow. In the typical separation chamber above described, in operation blood cells sediment in a radially acting centrifugal field along a distance of 0.45 cm. In this spiral configuration, blood flows "uphill" against a "g" force gradient which forces heavier cells to travel in an opposite direction to plasma and lighter cells (countercurrent flow), each fraction being continuously harvested through its respective terminal.

In tests made on a typical design substantially according to FIGS. 4, 5 and 6, the device was tested at up to 400 ml/min blood flow rate. The experiments showed highly efficient separations of plasma, platelets and lymphocytes from the whole blood.

Figure 7:
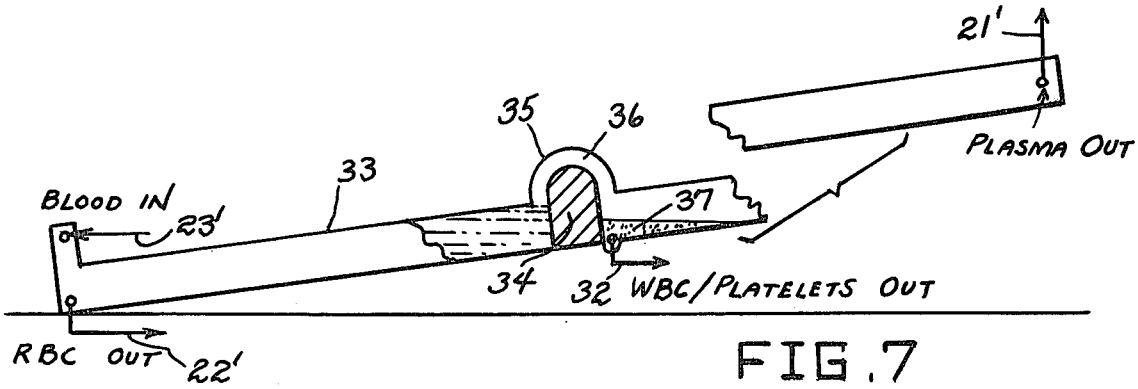
FIG. 7 is an enlarged diagrammatic fragmentary elevational view of a modified form of helical separation chamber in accordance with the present invention, partly in cross-section, shown in developed form.

FIG. 7 shows an embodiment providing more positive separation for white blood cells and platelet collection. In this embodiment, the collection chamber, shown at 33, has the same spiral helical configuration as in FIGS. 4, 5 and 6, but is provided at an intermediate location therein with an upstanding transverse rib or projection 34 and thereabove with a spaced conformably shaped top wall portion 35 to define an overflow channel 36 for plasma and white blood cells and platelets. Thus, in operation, the white blood cells and platelets settle in the corner portion defined by transverse rib 34 and the adjacent upper section of chamber 33, as shown at 37, for collection through outlet line 32.

The above-described system handles the blood components in an extremely gentle manner for individual harvesting. In this system, the blood may be exposed (in a countercurrent manner) to highly blood-compatible polymers, resulting in unusually low damage to blood cellular components. The capacity of the apparatus is relatively large, and in a typical embodiment it was possible to separate blood components at a flow rate as high as one unit of whole blood per minute. It is thus possible to withdraw from a donor, for example, only red blood cells (for red blood cell transfusion), or for example, only platelets (for platelet transfusion). The apparatus makes it possible to continuously harvest and concentrate platelets without damage for immediate use by a patient, with reduced need for the use of anticoagulants.

Figure 9:
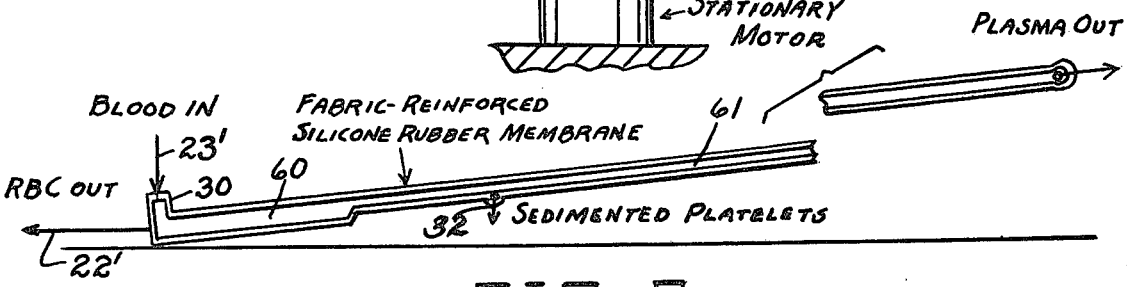
FIG. 9 is an enlarged fragmentary vertical longitudinal cross-sectional view of another modified form of helical separation chamber in accordance with the present invention, shown in developed form.

The separation chamber may be constructed of any suitable material having appropriate physical and chemical properties, and may comprise a plurality of helical turns, if so desired. For example, said separation chamber may be constructed of fabric-reinforced silicone rubber membrane and may comprise two complete helical turns. Also, the chamber may be made with a relatively large cross-sectional area 60 at its lower region (where deposit of red blood cells occurs) and with a more constricted cross-sectional area 61 through its remaining upper portion, as shown for example in FIG. 9.

FIG. 8 schematically illustrates a typical system for driving a centrifugal bowl assembly, as above described, without rotating seals. The bowl 11 is rigidly connected concentrically to a vertical sleeve 17 rotatably mounted on a frame 40, which in turn is secured on the vertical shaft 41 of a stationary electric motor 42. A vertical countershaft 43 is rotatably supported on frame 40 and is gearingly coupled to sleeve 17 by 1:1 gearing 44,45. At its lower end, countershaft 43 is gearingly coupled to a stationary gear 46 on motor 42 in a 1:1 ratio by a planet gear 47 and a toothed drive belt 48. Countershaft 43 is gearingly coupled with a 1:1 ratio to a vertical sleeve 49 rotatably supported on frame 40, by a gear 50 on shaft 43, a gear 51 on sleeve 49, and a toothed drive belt 52 gearingly engaging said gears 50,51.

The connection conduits, for example, 21, 22, 23, are designated as a bundle 53, and pass through sleeves 17 and 49 in the manner shown schematically in FIG. 8, and then pass through an aperture 54 in a stationary top wall 55 en route to their various destinations.

In operation, the drive shaft 41 of the motor 42 drives the frame 40 at a particular selected angular velocity $\omega$, (for example, at 500 RPM). The gear 47 which is fixed to the countershaft 43 rotates about the axis of rotation of the drive shaft 41. Also, because of its connection, via the toothed belt 48, to the fixed gear 46, this causes the countershaft 43 to rotate relative to frame 40. As a result, gear 44 drives gear 45 at an angular velocity of $2\omega$ because of the 1:1 gear ratio. As a further result, the bowl 11, fixed to hollow shaft 17, rotates at an angular velocity of $2\omega$ (1000 RPM).

At the same time, the gear 50, rotating with the countershaft 43, drives the toothed belt 52, which in turn drives the gear 51 fixed to the hollow shaft 49. This causes hollow shaft 49 to rotate about its own axis at an angular velocity of $-\omega$. As a consequence of this, the bundle 53 of the flexible tubes 21, 22, 23 does not become twisted and yet allows fluid communication into and out from the centrifuge chamber in bowl 11 without the presence of any rotating seals.

Figure 10:
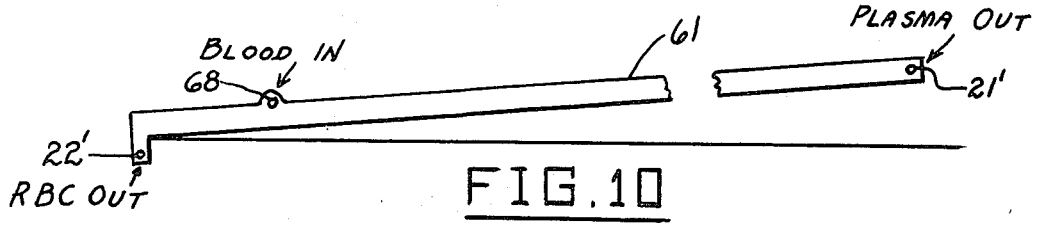
FIG. 10 is an elevational developed view of a separation chamber similar to that shown in FIGS. 4 to 6, but showing an alternative blood inlet location.
Figure 11:
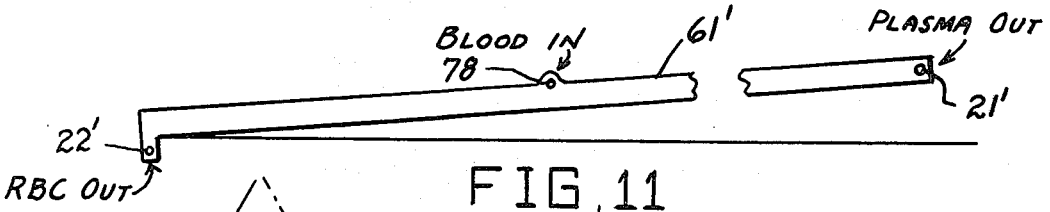
FIG. 11 is an elevational developed view similar to FIG. 10, but showing another blood inlet location for the separation chamber.

FIGS. 10 and 11 show, in developed form, additional spiral helical separation chambers according to the present invention, generally similar to that of FIGS. 4 to 6 but with blood inlets, shown respectively at 68 and 78, located at points spaces upwardly from the red blood cell outlets 22. In FIG. 10, the separation chamber, designated generally at 61, has its blood inlet 68 located a short distance upwardly from the red blood cell outlet at the lower end of the chamber, thus maintaining an "uphill" separation between the blood inlet 68 and the red blood cell outlet 22'. FIG. 11 is similar, but in this embodiment the blood inlet 78 is located a longer distance upwardly along the separation chamber, designated at 61'. As in FIG. 10, there is a substantial "uphill" separation of the blood inlet 78 from the red blood cell outlet 22' at the lower end of the chamber.

Figure 12:
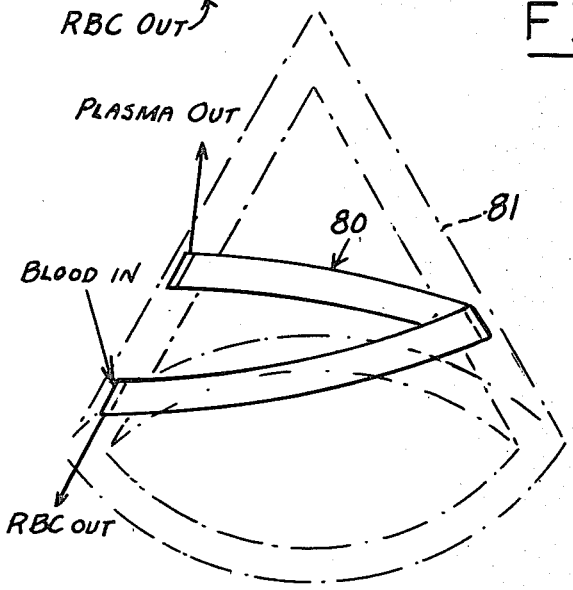
FIG. 12 is a diagrammatic perspective view of a conical helical spiral separation chamber in accordance with the present invention.
Figure 13:
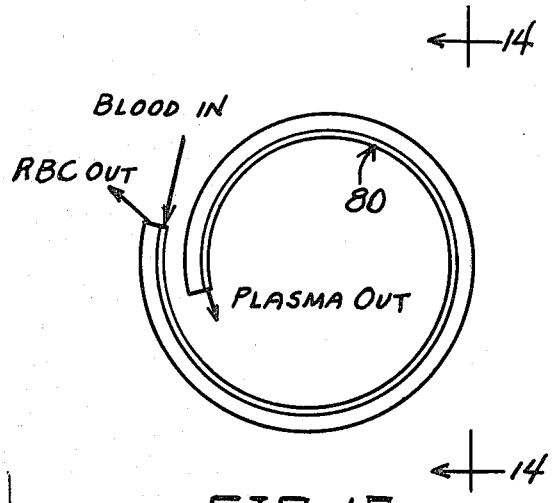
FIG. 13 is a top plan view of the conical helical separation chamber of FIG. 12.
Figure 14:
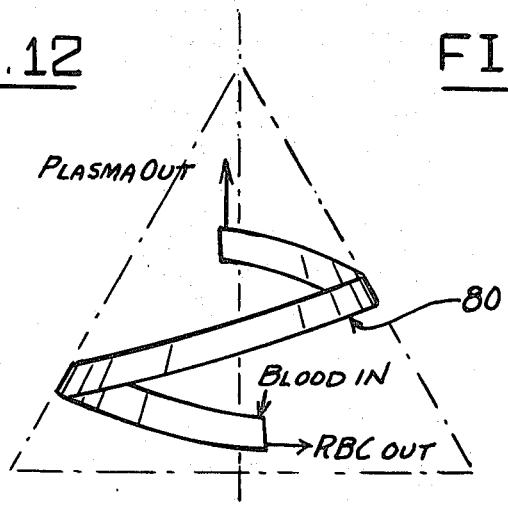
FIG. 14 is an elevational view of the separation chamber of FIGS. 12 and 13, said view being taken substantially on line 14–of FIG. 13.

FIGS. 12 to 14 show a further embodiment of the present invention wherein the ring-like rotor chamber, shown at 80, is of generally conical spiral helical form, and may be mounted in a hollow conical "bowl" member 81 rotating around its vertical axis. As will be seen from FIG. 12, the cross-section of the separation chamber is tilted at an angle to the direction of the shaft of the centrifuge, namely, at the slope angle of the associated generating cone, thus providing another plane of separation, yielding a second stage of "uphill travel" in addition to the basic one along the length of the chamber, as previously described, wherein the blood flows "uphill" against a "g" force gradient which forces heavier cells to travel in an opposite direction to plasma and lighter cells.

It is to be noted that along with separation of other blood components, the apparatus of the present invention can be utilized for the separation of white blood cells into fractional components, including granulocytes, lymphocytes, and other fractions of the white blood cell population.

A particular advantage of the present invention, besides its capacity to more effectively separate various components of the blood in a more effective manner and with less damage to such components, is its ability to function effectively without, or with reduced quantities of, anticoagulants.

While specific embodiments of an improved flow-through blood centrifuge system and rotor chambers employed therein have been disclosed in the foregoing description, it will be understood that various modifications within the scope of the invention may occur to those skilled in the art. Therefore it is intended that adaptations and modifications should and are intended to be comprehended within the meaning and range of equivalents of the disclosed embodiments.

What is claimed is:

1. A flow-through blood centrifuge apparatus comprising a vertically-mounted centrifugal bowl member mounted on a vertical axis, means for rotating said bowl member about said axis, a rotor chamber disposed substantially concentrically in said bowl member, blood inlet conduit means communicatively connected to said rotor chamber near the periphery thereof for admitting whole blood into said chamber, outlet conduit means, and means to communicatively connect said outlet conduit means to the rotor chamber at a level to collect a selected blood component during a flow-through procedure, wherein said rotor chamber is of substantially helical form having an upper end and a lower end, wherein said chamber is provided at its lower end with an enlargement defining an enclosure, wherein said outlet conduit means includes a flexible tube communicatively connected to the lower portion of said enclosure for collecting red blood cells, and wherein said apparatus includes a flexible tube communicatively connected to the upper end of the chamber for collecting plasma.

2. The centrifuge apparatus of claim 1, and wherein said apparatus further includes a flexible tube communicatively connected to an intermediate portion of the chamber for collecting white blood cells and platelets.

3. The centrifuge apparatus of claim 1, and wherein said blood inlet conduit means comprises a flexible conduit communicatively connected to the upper portion of said enclosure.

4. The centrifuge apparatus of claim 3, and wherein the lower portion of said helically formed chamber is relatively larger in cross-sectional size than the remaining upper portion of said chamber.

5. The centrifuge apparatus of claim 1, wherein said helical rotor chamber is of disposable material.

6. A flow-through blood centrifuge apparatus comprising a vertically-mounted centrifugal bowl member mounted on a vertical axis, means for rotating said bowl member about said axis, a rotor chamber disposed substantially concentrically in said bowl member, blood inlet conduit means communicatively connected to said rotor chamber near the periphery thereof for admitting whole blood into said chamber, outlet conduit means, and means to communicatively connect said outlet conduit means to the rotor chamber at a level to collect a selected blood component during a flow-through procedure, and wherein said rotor chamber is of substantially helical form and is provided at an intermediate portion with an upstanding obstruction, and wherein said outlet conduit means includes a flexible conduit communicatively connected to the chamber upwardly adjacent to said obstruction for collecting white blood cells and platelets.

7. A flow-through blood centrifuge apparatus comprising a vertically-mounted centrifugal bowl member mounted on a vertical axis, means for rotating said bowl member about said vertical axis, a rotor chamber disposed substantially concentrically in said bowl member, blood inlet conduit means communicatively connected to said rotor chamber near the periphery thereof for admitting whole blood into said chamber, outlet conduit means, and means to communicatively connect said outlet conduit means to the rotor chamber at a level to collect a selected blood component during a flow-through procedure; wherein said chamber is of substantialy helical form having an upper end and a lower end and is provided at its lower end with means defining an upwardly enlarged enclosure, wherein said inlet conduit means comprises a first flexible conduit communicatively connected to the upper portion of said enclosure, and wherein said outlet conduit means comprises a second flexible conduit communicatively connected to the lower portion of said enclosure for collecting red blood cells.

8. The centrifuge apparatus of claim 7, and at least one additional flexible outlet conduit communicatively connected to the chamber at a location spaced from said enclosure.

9. The centrifuge apparatus of claim 7, and a third flexible outlet conduit communicatively connected to the upper end of the chamber for collecting plasma.

10. The centrifuge apparatus of claim 9, and a fourth flexible outlet conduit communicatively connected to an intermediate portion of the chamber for collecting other whole blood components.

11. A flow-through centrifuge apparatus comprising a bowl member mounted on a vertical axis; means for rotating said bowl member about said axis, a tubular rotor chamber of substantially helical form disposed substantially concentrically in said bowl member, said tubular chamber having a first end, a second end and a radial extent; first outlet conduit means communicatively coupled to said tubular rotor chamber at a first given radial distance from said axis for removing a heavy fraction during flowthrough procedure; second outlet conduit means communicatively coupled to said tubular rotor chamber at a second given radial distance for removing a light fraction during flow-through procedure; and inlet conduit means communicatively connected to said tubular rotor chamber for admitting material to be separated into said tubular chamber, at a third given radial distance from said axis intermediate said first radial distance and said second radial distance; whereby during flow-through procedure, the heavier phase of the material supplied via the inlet conduit means travels along the tubular rotor chamber, toward said first end and the lighter phase of the material travels along the tubular rotor chamber toward said second end, the heavier and lighter phases forming an interface within the tubular rotor chamber.

12. The centrifuge apparatus of claim 11, wherein said inlet conduit means is connected to said chamber intermediate its said ends.

13. The centrifuge apparatus of claim 12, wherein said tubular rotor chamber has a substantially rectangular cross-section.

14. The centrifuge apparatus of claim 11, wherein said tubular rotor chamber has the form of a conical spiral.

15. The centrifuge apparatus of claim 14, wherein said tubular rotor chamber has a substantially rectangular cross-section.

16. The centrifuge apparatus of claim 11, wherein said tubular rotor chamber is provided at said first end with an enlargement defining an enclosure, and wherein said first outlet conduit means includes a flexible tube communicatively connected to a lower portion of said enclosure for collecting red blood cells.

17. The centrifuge apparatus of claim 11, wherein said first end is positioned lower than said second end and said chamber is provided at its said first end with an enlargement defining an enclosure, and wherein said first outlet conduit means includes a flexible tube communicatively connected to a lower portion of said enclosure for collecting red blood cells.

18. The centrifuge apparatus of claim 17, wherein said second outlet conduit means includes a flexible tube communicatively connected to said second end of the chamber for collecting plasma.

19. The centrifuge apparatus of claim 18, wherein said apparatus further includes an additional flexible tube communicatively connected to an intermediate portion of said chamber for collecting white blood cells and platelets.

20. The centrifuge apparatus of claim 18, wherein said inlet conduit means comprises a flexible conduit communicatively connected to an upper portion of said enclosure for supplying blood to said chamber.

21. The centrifuge apparatus of claim 20, wherein a lower portion of said helically formed chamber is relatively larger in cross-sectional size than the remaining upper portion of said chamber.

22. The centrifuge apparatus of claim 11, wherein said rotor chamber is provided at an intermediate portion with an upstanding obstruction, and the apparatus includes outlet conduit means comprising a flexible conduit communicatively connected to said chamber upwardly adjacent to said obstruction for collecting white blood cells and platelets.

23. The centrifuge apparatus of claim 11, wherein said first end of said is lower than said second end of said chamber and said chamber is provided at its said first end with means defining an upwardly enlarged enclosure, and wherein said inlet conduit means comprises a first flexible conduit communicatively connected to an upper portion of said enclosure, and wherein said first outlet conduit means comprises a second flexible conduit communicatively connected to a lower portion of said enclosure for collecting red blood cells.

24. The centrifuge apparatus of claim 23, and at least one additional flexible outlet conduit communicatively connected to the chamber at a location spaced from said enclosure.

25. The centrifuge apparatus of claim 23, and wherein said second outlet conduit means comprises, a third flexible conduit communicatively connected to said second end of the chamber for collecting plasma.

26. The centrifuge apparatus of claim 25, and a fourth flexible outlet conduit communicatively connected to an intermediate portion of said chamber for collecting other whole blood components.

27. The centrifuge apparatus of claim 11, wherein said chamber has a substantially rectangular cross-section.

28. The centrifuge apparatus of claim 11, wherein said tubular chamber is disposable.

* * * * *